US006195968B1

(12) United States Patent
Marois et al.

(10) Patent No.: US 6,195,968 B1
(45) Date of Patent: Mar. 6, 2001

(54) APPARATUS FOR WRAPPING A LOAD

(75) Inventors: Yanick Marois, Ascot Corner; Glen Ditchburn, Ayer's Cliff, both of (CA)

(73) Assignee: Wulftec International Inc., Quebec (CA)

( * ) Notice: Subject to any disclaimer, the term of this patent is extended or adjusted under 35 U.S.C. 154(b) by 0 days.

(21) Appl. No.: 09/349,069

(22) Filed: Jul. 8, 1999

(51) Int. Cl.[7] ..... B65B 11/04
(52) U.S. Cl. ..... 53/588; 53/138.2
(58) Field of Search ..... 53/399, 587, 588, 53/210, 211, 215, 138.2

(56) References Cited

U.S. PATENT DOCUMENTS

| | | | | |
|---|---|---|---|---|
| 4,271,657 | | 6/1981 | Lancaster, III et al. | 53/399 |
| 4,299,076 | | 11/1981 | Humphrey | 53/587 |
| 4,300,326 | * | 11/1981 | Stackhouse | 53/211 |
| 4,432,185 | | 2/1984 | Gelsinger | 53/138 |
| 4,631,898 | | 12/1986 | Brambilla | 53/399 |
| 4,691,497 | | 9/1987 | Lancaster | 53/399 |
| 4,831,812 | | 5/1989 | Cocher et al. | 53/399 |
| 5,005,335 | | 4/1991 | Yourgalite et al. | 53/399 |
| 5,054,263 | | 10/1991 | Mäki-Rahkola et al. | 53/399 |
| 5,107,657 | | 4/1992 | Diehl et al. | 53/141 |
| 5,168,691 | | 12/1992 | Errani | 53/587 |
| 5,301,493 | | 4/1994 | Chen | 53/556 |
| 5,408,808 | | 4/1995 | Masuda et al. | 53/556 |
| 5,423,163 | | 6/1995 | Wendt | 53/556 |
| 5,450,709 | | 9/1995 | Steding | 53/465 |
| 5,606,849 | | 3/1997 | Bettenhausen | 53/556 |
| 5,623,808 | | 4/1997 | Franklin et al. | 53/399 |
| 5,628,167 | | 5/1997 | Huson et al. | 53/465 |
| 5,701,722 | | 12/1997 | Franklin et al. | 53/399 |
| 5,787,691 | | 8/1998 | Turfan et al. | 53/588 |
| 5,794,418 | | 8/1998 | Lai | 53/556 |
| 5,802,810 | | 9/1998 | Wojcik et al. | 53/399 |
| 5,836,140 | | 11/1998 | Lancaster, III | 53/399 |

* cited by examiner

*Primary Examiner*—Linda Johnson
(74) *Attorney, Agent, or Firm*—Myers Bigel Sibley & Sajovec

(57) ABSTRACT

The present invention concerns an apparatus for wrapping a load with a flexible wrapping material which prevents the flexible material from unwrapping itself after the load has been wrapped. The apparatus includes a supply of flexible wrapping material which can be delivered as a rope or as a full web. The apparatus includes a first finger and a gripper for positioning a portion of a first rope supplied by the supplying means at a predetermined location. The load and the supply are relatively moved to wrap the load with the flexible material. Once the load has been wrapped, a second finger and a guide wheel are provided to position a portion of a second rope supplied by the supply at the predetermined position. The first and second ropes are fastened together at the predetermined position, and the portion of the second rope is cut downstream of the predetermined position. Preferably, before the second rope is cut, the gripper is moved to grip the portion of the second rope, which is used as a first rope for a subsequent load. The present invention is also concerned with a method for wrapping a load.

6 Claims, 18 Drawing Sheets

APPARATUS FOR WRAPPING A LOAD

FIELD OF THE INVENTION

The present invention relates to an apparatus and method for wrapping a load by means of a flexible material. More specifically the invention relates to an apparatus for treating the two tails, or ropes, of a flexible wrapping material in a pallet wrapping machine.

DESCRIPTION OF THE PRIOR ART

Pallet wrapping machines are well known in the art, and consist essentially of a frame on which is rotatably mounted a roll of flexible material. The flexible material is brought close to a load, usually conveyed by a conveyor to a wrapping area.

Presently, flexible material producers are marketing film material that can be stretched up to 300% of the original length, which creates considerable tension during the wrapping cycle (tension is created when the wrapping material is stretched because it is trying to get back to its original length).

Producers are also adding a tacky side to the material which helps one layer to stick to the one previously applied. Static is also produced when film is stretched which also helps to stick to the previously applied layer.

Another material that is frequently used in pallet wrapping machines is netting, commonly used for fresh fruits and vegetables. A few years ago, netting was not stretchable, but now netting producers are marketing netting that can be stretched up to 200%. Netting does not have a tacky side, nor does it produce enough static to make the web stick to the load. A load wrapped with netting would start unwrapping itself as soon as the web would be cut free to wrap a subsequent load.

Known in the art is U.S. Pat. No. 4,432,185 to Geisinger, which discloses a pallet wrapper including a mechanism to hold a portion of the flexible material in position prior to wrapping a load. The pallet wrapper includes an anvil member movable into a position against the side of the pallet, and a clamp movable with the anvil and adapted to hold the portion of the flexible material. Once the anvil and the clamp are positioned against the side of the pallet, wrapping of the pallet is effected by known means. After the pallet has been wrapped at least by covering with the flexible material the portion of the flexible material held by the clamp, the clamp is released and retracted and the wrapping of the pallet completed. After the pallet is completely wrapped, the clamp is moved back into position to clamp a roped section of the web adjacent the clamp and a securing mechanism is advanced to cooperate with the anvil to secure the web adjacent the clamp to the underlying roped layer of the web. A cut-off mechanism is advanced to cut the web between the clamp and the point of securement.

However, this pallet wrapper relies on the fact that there is a small amount of tension in the wrapping material to maintain the portion of the flexible material in position during transportation of the pallet. If the flexible material is stretchable netting in the Geisinger machine, this portion of the flexible material is loose, and can unwind during transport. Using the Geisinger machine with stretchable netting is not an efficient, nor satisfactory process, since the portion of the flexible material that is "held" by the wrapped flexible material will not stay in place, and the pallet will eventually become unwrapped.

SUMMARY OF THE INVENTION

It is an object of the present invention to provide an apparatus for wrapping a load by means of a flexible material which ties a first and second rope portions together, preventing the flexible material from unwrapping itself. In accordance with the invention, this object is achieved with an apparatus comprising:

- supplying means for supplying the flexible wrapping material as a rope or as a full web;
- first positioning means for positioning a portion of a first rope supplied by the supplying means at a predetermined location;
- means for effecting relative movement between the load and the supplying means to wrap the load by means of a full web supplied by the supplying means;
- second positioning means for positioning a portion of a second rope supplied by the supplying means at the predetermined location;
- fastening means for fastening together said portions of the first and second ropes at said predetermined location;
- cutting means for cutting the second rope between the portion thereof that has been fastened and the supplying means; and
- controlling means connected to the supplying means, the first and second positioning means, the means for effecting relative movement, the fastening means and the cutting means, for controlling operation thereof.

According to the present invention, there is also provided a method for wrapping a load, comprising the steps of:

(a) supplying a flexible material as a first rope having an end portion;

(b) positioning the end portion of the first rope at a predetermined location;

(c) after step (b), supplying the flexible material as a full web;

(d) wrapping the load by means of the full web;

(e) after step (d), supplying the flexible material as a second rope;

(f) extending a portion of the second rope at the predetermined location;

(g) fastening the end portion of the first rope to the portion of the second rope at the predetermined location;

(h) cutting a section of the second rope that is upstream to the predetermined location.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF PREFERRED EMBODIMENTS OF THE INVENTION

Figure 1:
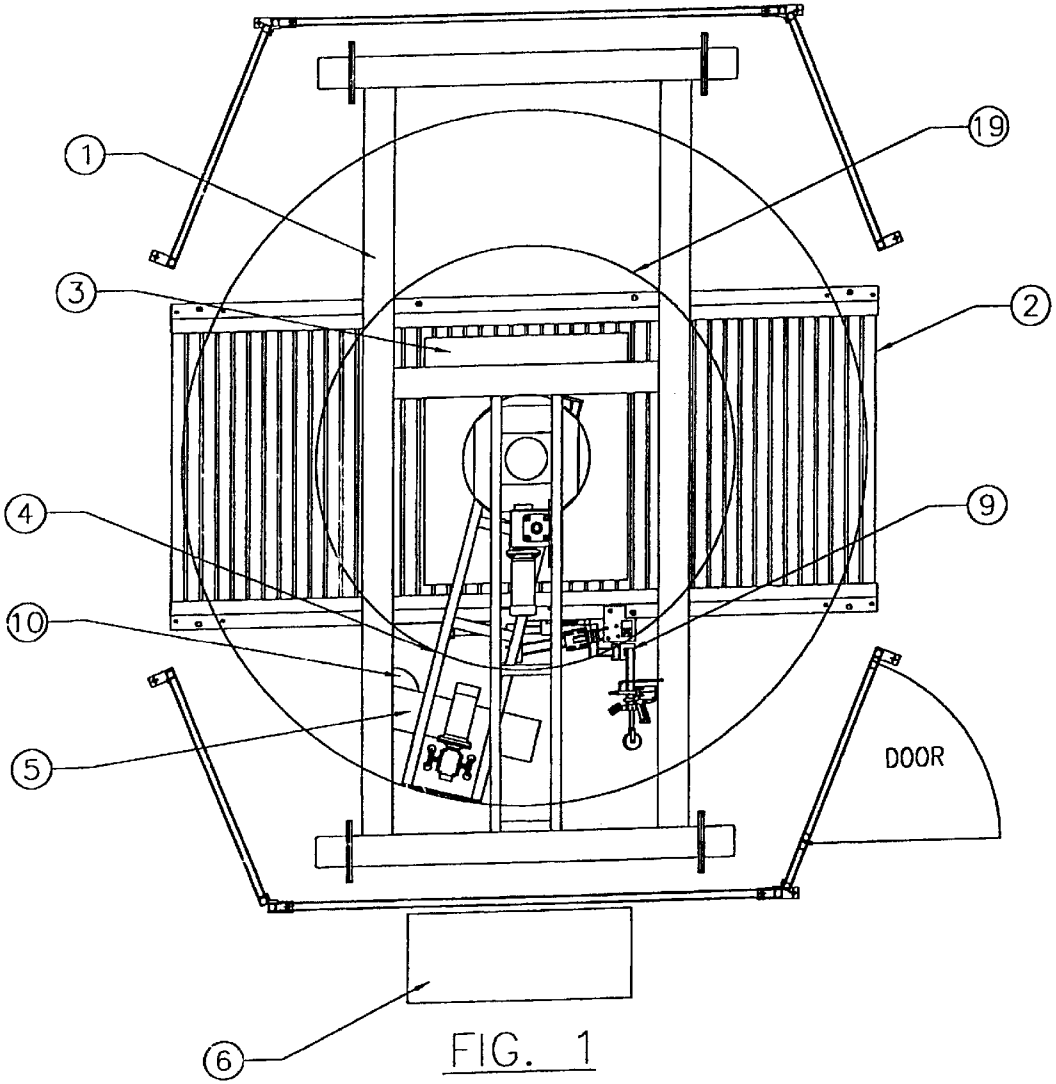
FIG. 1 is a top view of an apparatus according to a preferred embodiment of the invention where the conveyor is fixed.
Figure 2:
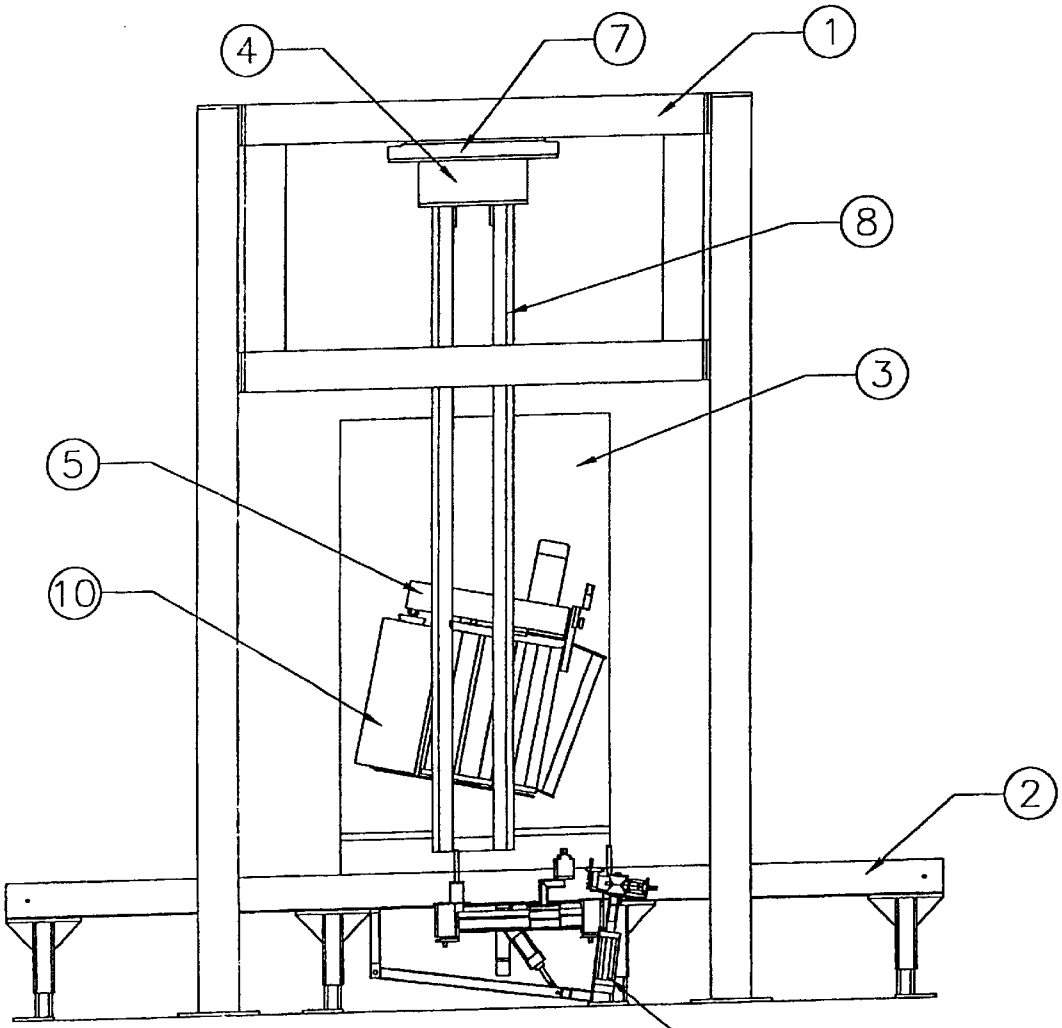
FIG. 2 is a side elevational view of the apparatus of FIG. 1.
Figure 3:
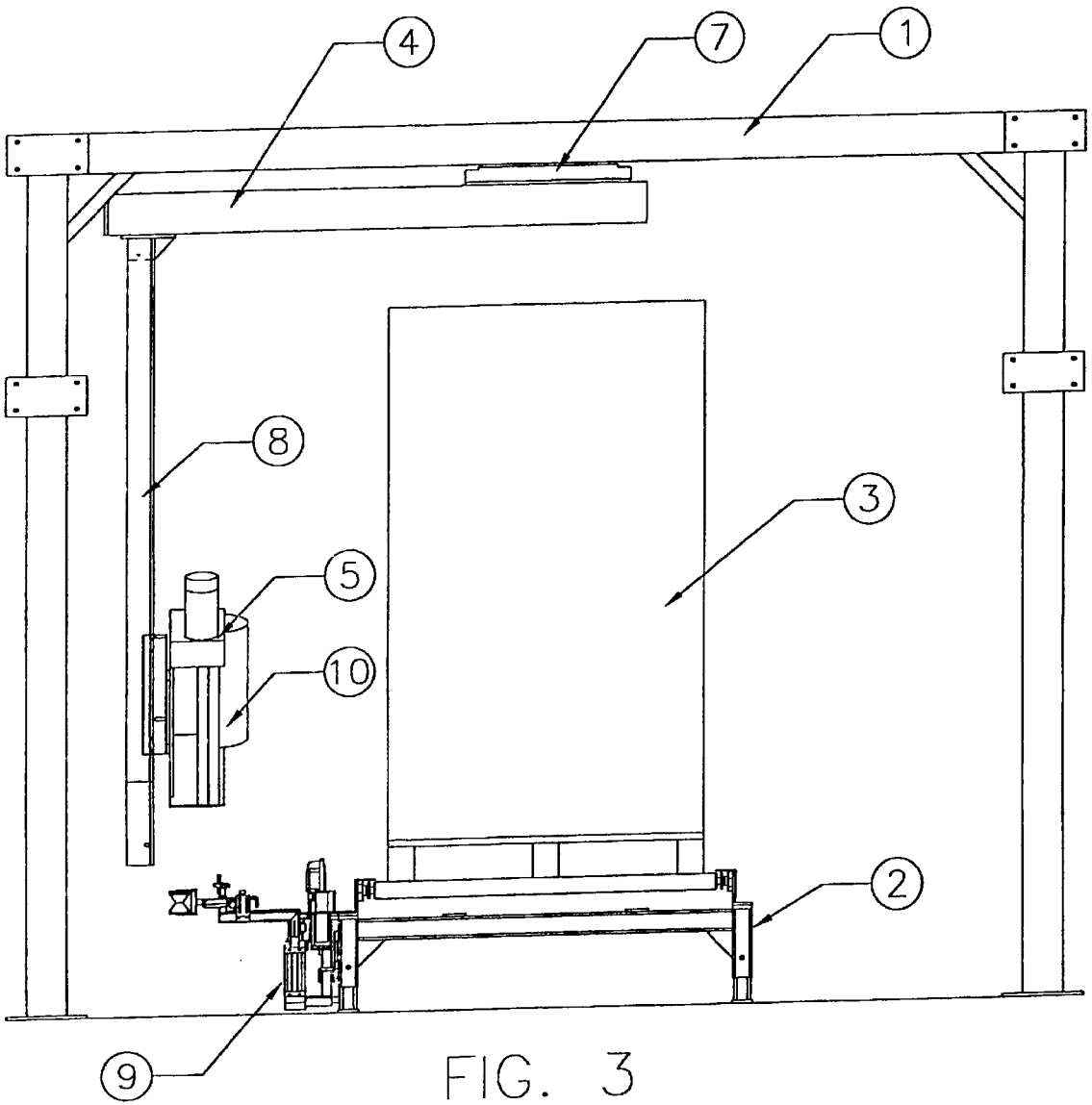
FIG. 3 is a rear elevational view of the apparatus of FIG. 1.

Referring now to FIGS. 1–3, the apparatus of the present invention includes a frame 1 through which a conveyor 2 runs. On the frame 1 is mounted a flexible material carriage 5. The flexible material carriage 5 includes a roll of flexible material 10 rotatably mounted on the carriage 5.

A load 3 to be wrapped is conveyed into a wrapping area by the conveyor 2. As in the prior art, the apparatus includes means for effecting relative movement between the load and the supplying means in order to wrap the load. FIGS. 1–3 show a preferred embodiment of the apparatus, where the supplying means are mounted on an arm 4 through a boom 8, the arm 4 being rotatably mounted on the frame 1 through a ring gear 7. Relative movement of between the load and the supplying means is effected by moving the arm 4 around the load.

Referring now to FIGS. 4 to 13, the present invention, as mentioned above, concerns the addition, to a prior art apparatus, of first positioning means for positioning a portion of a first rope supplied by the supplying means at a predetermined location; second positioning means for positioning a portion of a second rope supplied by the supplying means at the predetermined location; fastening means for fastening together said portions of the first and second ropes at said predetermined location; and cutting means for cutting the second rope between the portion thereof that has been fastened and the supplying means.

Figure 4:
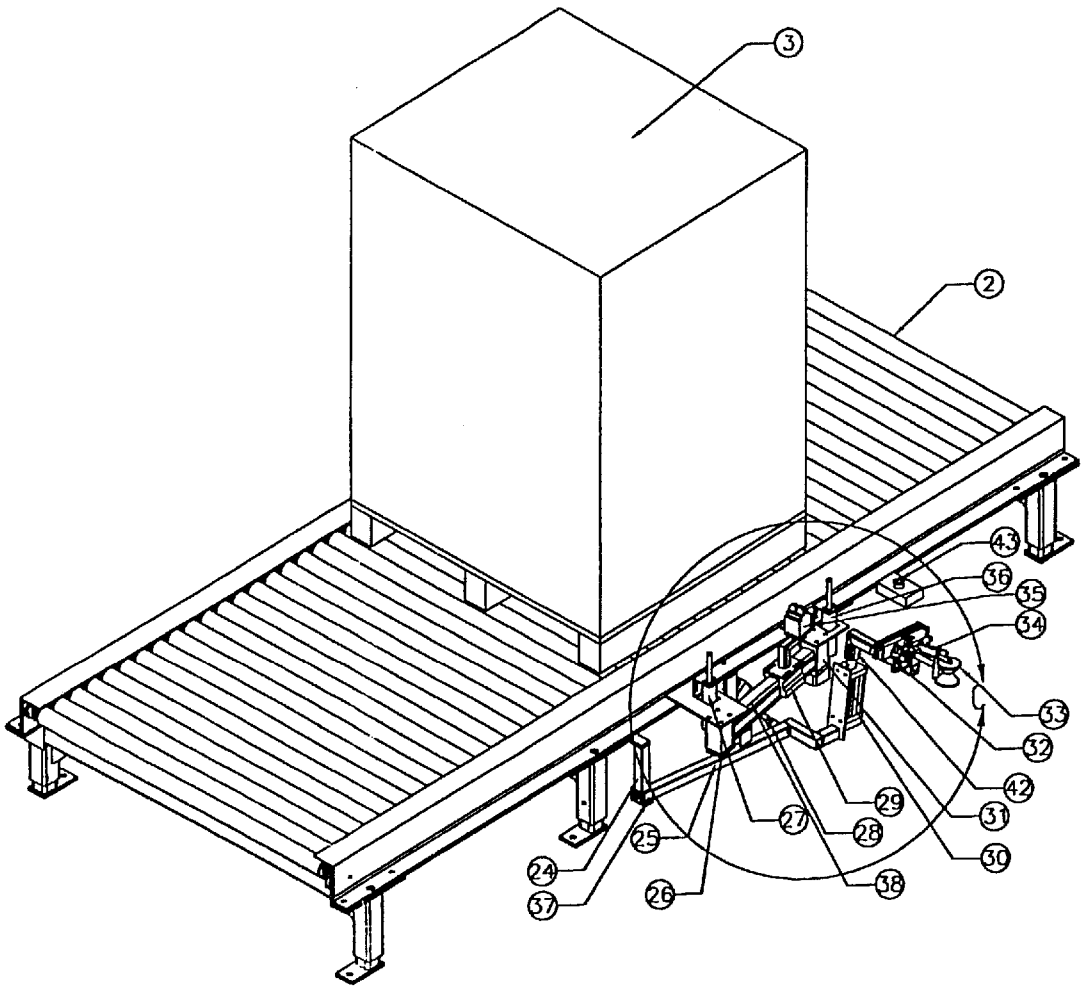
FIG. 4 is a schematic perspective view of the apparatus according to the present invention, showing schematically the location of the first positioning means, the second positioning means, the fastening means and the cutting means, there are also shown the conveyor and the load.

More specifically, FIG. 4 shows schematically the location of the first positioning means, the second positioning means, the fastening means and the cutting means, identified by reference numeral 9. The supplying means are mounted on the carriage 5 shown in FIGS. 1 to 3.

Referring again to FIGS. 4–13, the first positioning means include a first gripper 35 for gripping an end of a portion of the first rope 39 upstream of a predetermined position 40 (see FIG. 9); and a first finger 27 located downstream of the predetermined location 40 for positioning the portion of the first rope from the first gripper 35.

The second positioning means include a second finger 36 for locating an end of a portion of a second rope 44 upstream of the predetermined location; a movable guiding wheel 33 for positioning and guiding the second rope; and moving means 30 for moving the guide wheel between a standby position and an active position, where the portion of the second rope is positioned downstream from the second finger, at the predetermined location.

The fastening means preferably include a clipper 34 for clipping together the portions of the first and second ropes together at the predetermined location 44, and means 30 for moving the clipper 34 between an operative position and an inoperative position.

The cutting means preferably include a heat wire 32, and means for moving the heat wire 32 from an inoperative position to an operative position, where the heat wire is in contact with the second rope 44. Also preferably, the cutting means further include a second gripper 35 for gripping the second rope between the portion thereof that has been fastened and the supplying means so that the second rope is held in position to be cut between the second gripper and the portion thereof that has been fastened. In this preferred embodiment, the first gripper and the second gripper are a single gripper 35 which is movable between a first operating position and a second operating position, as will be hereinafter detailed.

Figure 5:
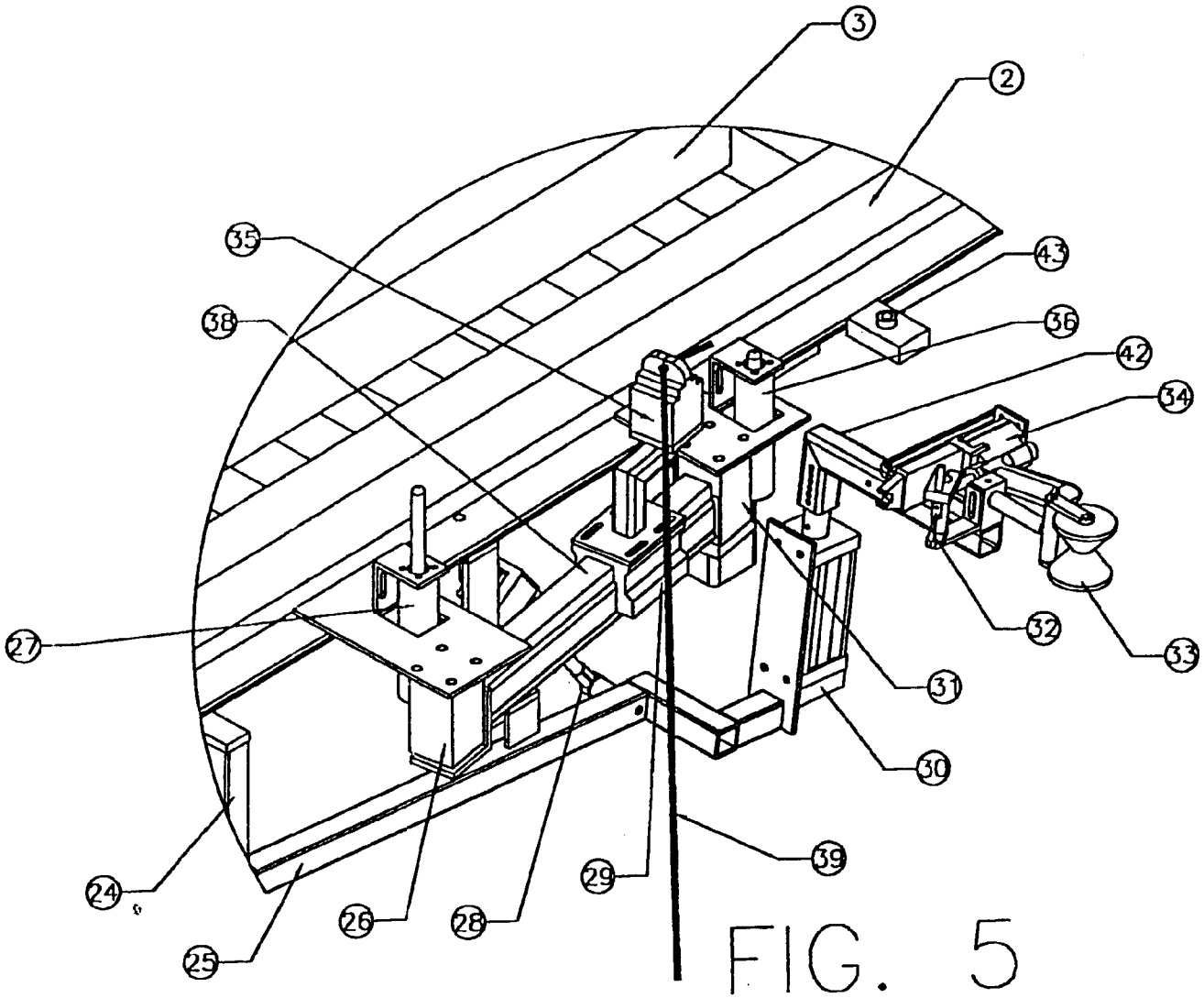
FIGS. 5 to 13 are enlarged views of the circled portion of FIG. 4, showing components of the apparatus in different operating position.

At the very beginning, a first rope 39 is made from the flexible material 10, and the rope 39 is loaded into the gripper 35 by pressing push-button 43 to open the gripper. As can be seen in FIG. 5, the gripper 35 is mounted on a rod-less cylinder 38 via a rod-less carriage 29, the rod-less cylinder being mounted between two up/down movement cylinders 31 and 26, each fastened to the apparatus frame.

Figure 6:
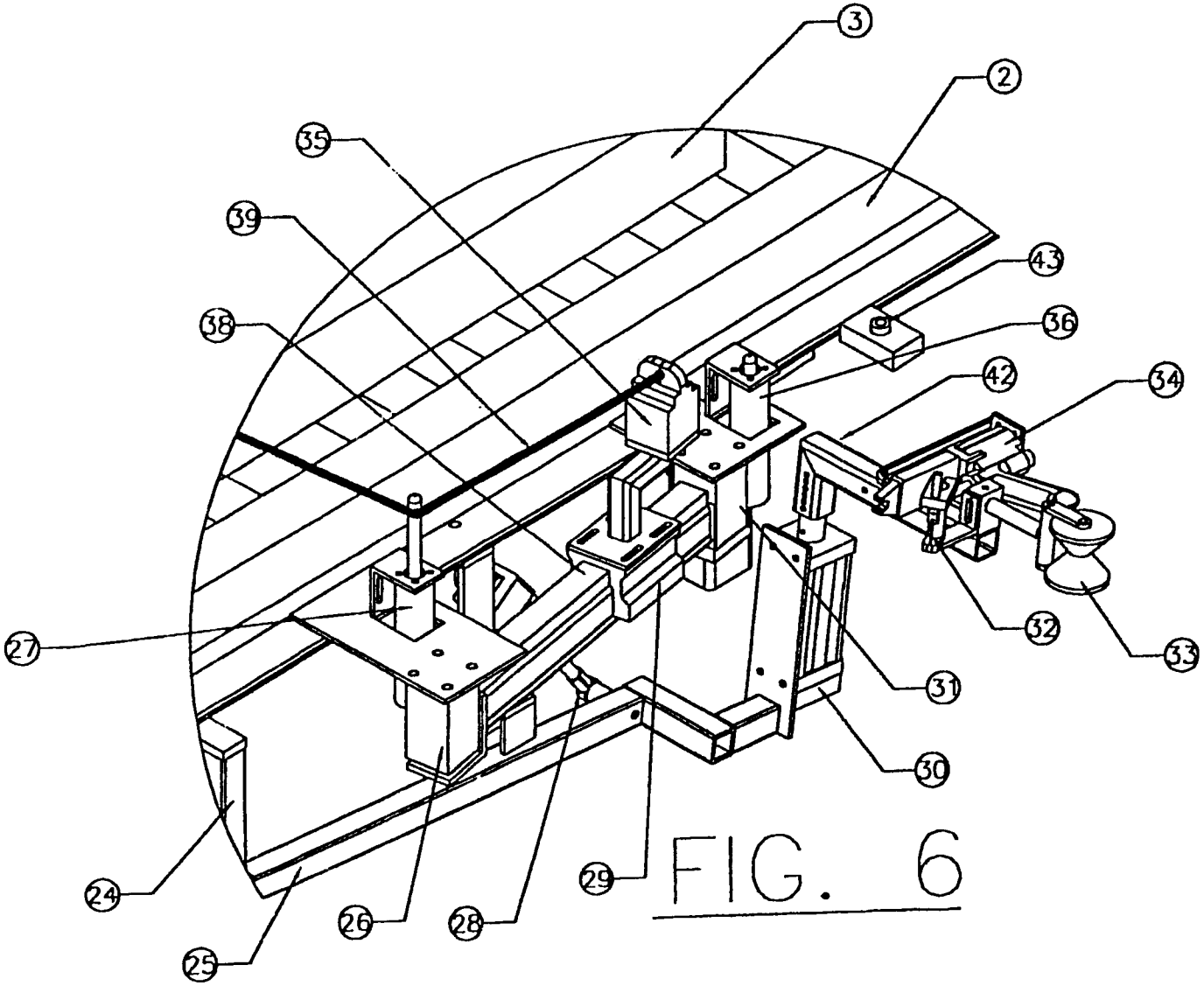

A load 3 is brought to the wrapping area by means of the conveyor 2. The supplying means are directed to supply the flexible material as a rope, and relative movement between the supplying means and the load is effected. As this movement occurs, the rope 39 catches on the first finger 27, as seen in FIG. 6.

After the rope 39 passes the first finger 27, the supplying means are directed to supply the flexible material 10 as a full web, and wrapping of the load 3 by usual procedures is effected. Preferably, the load can be tied by rotating the rope 39 around the load before it is wrapped.

Figure 7:
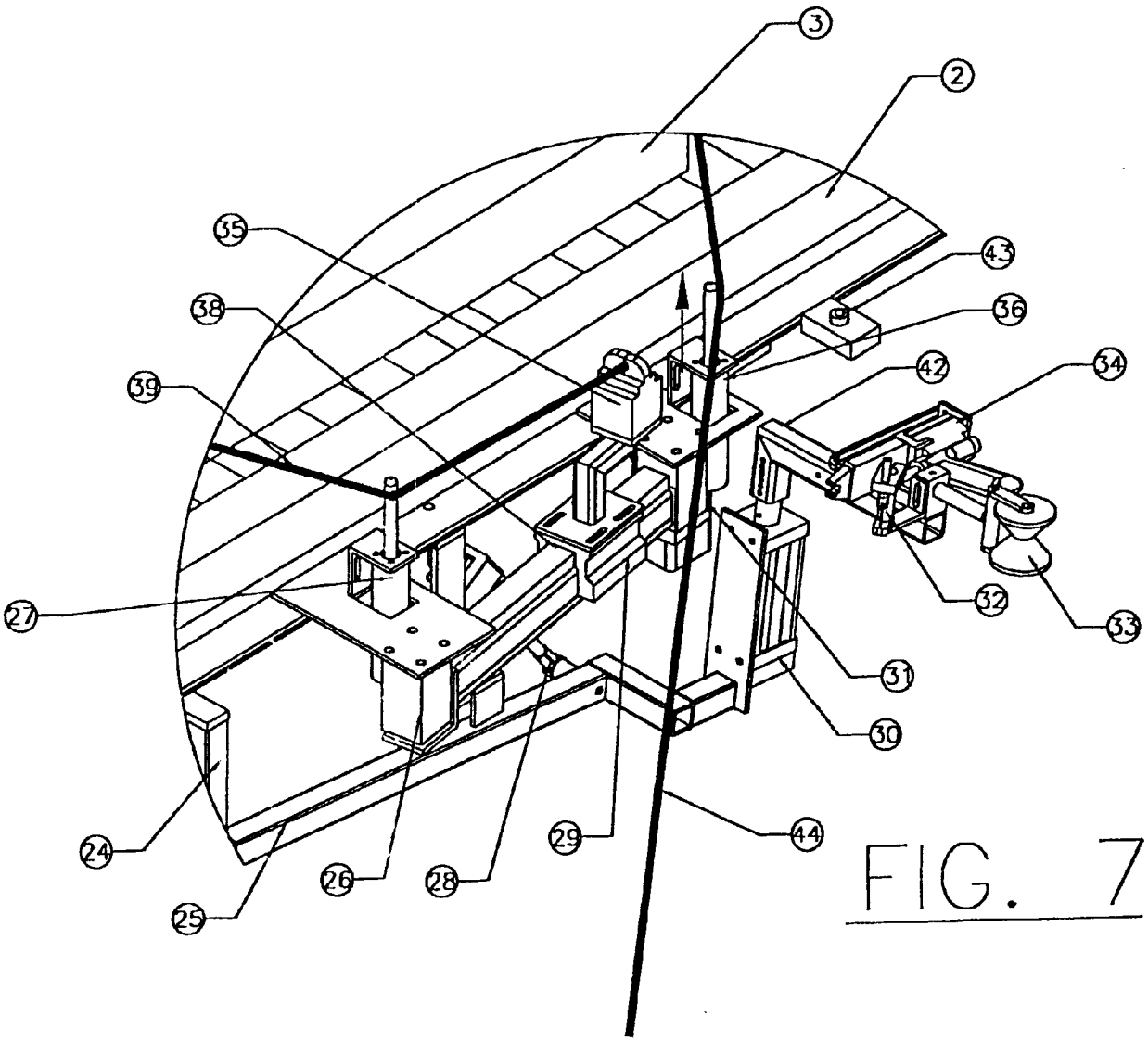

Once the load has been wrapped, the supplying means are directed to supply the flexible material 10 as a second rope 44 (see now FIG. 7).

The second finger 36, which is movable between an operative position and an inoperative position, is brought from the inoperative position to the operative position, i.e. it is raised. The second rope 44 is caught by the second finger 36 in order to place the second rope 44 in the required position. At this point, relative movement between the load 3 and the supplying means is stopped.

The guide wheel 33 is mounted on a clipping arm 42, in turn mounted on a clipping arm rotary actuator 30. The actuator 30 is mounted to a lifting arm 25 and secured to the frame by a bracket 24 and a lifting arm pivot point 37. The lifting arm is movable between a rest position and an operative position by means of a lifting arm cylinder 28.

Figure 8:
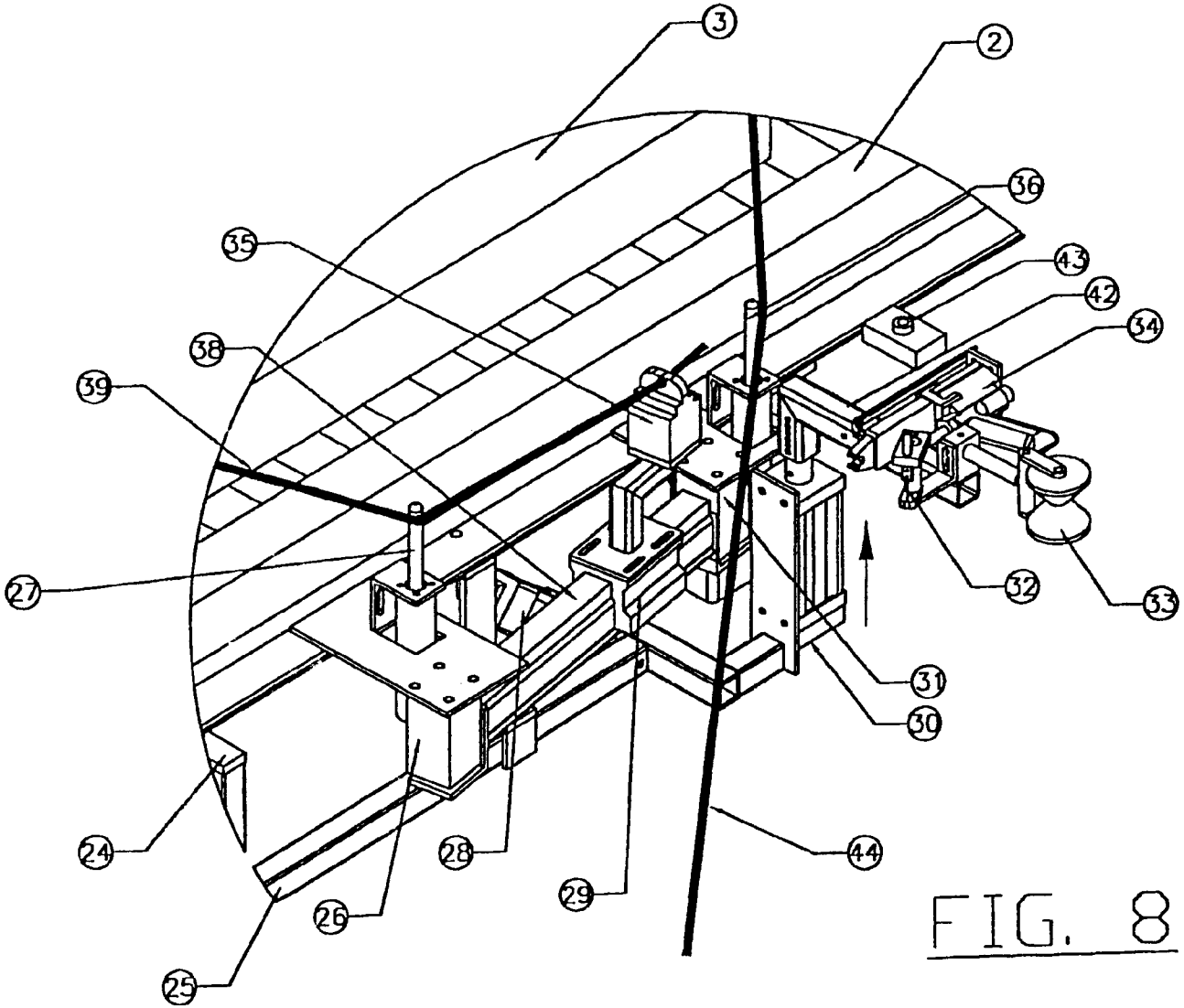
Figure 9:
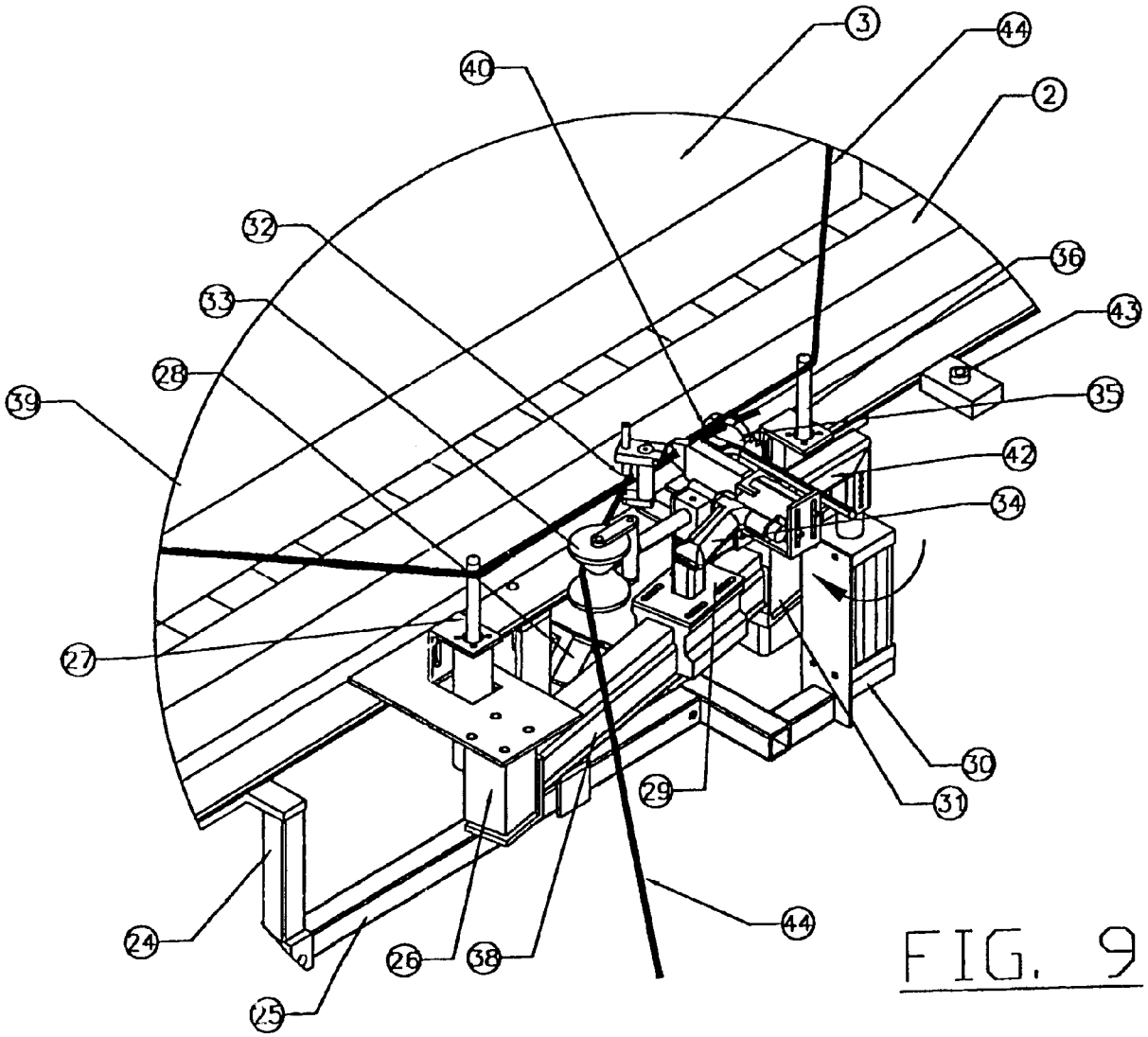

The clipping arm 25 is moved from the rest position (FIG. 7) to the operative position (FIG. 8). The actuator is then rotated from its rest position to its operative position, causing the guide wheel 33 to push against the second rope 44 (FIG. 9), and thus align the two ropes at a predetermined position 40.

As can be seen from the Figures, the clipper is also preferably mounted on the clipping arm 42. When the guide wheel pushes against the second rope 44 to align the first and second ropes together, the clipper is actuated to clip the first and second ropes together.

Once the first and second ropes have been clipped together, a heat wire 32 may be activated to cut a portion of the second rope 44 downstream of the predetermined position 40, thereby releasing the load. This would however mean that a person would have to manually reload the gripper 35 for the next cycle.

Figure 10:
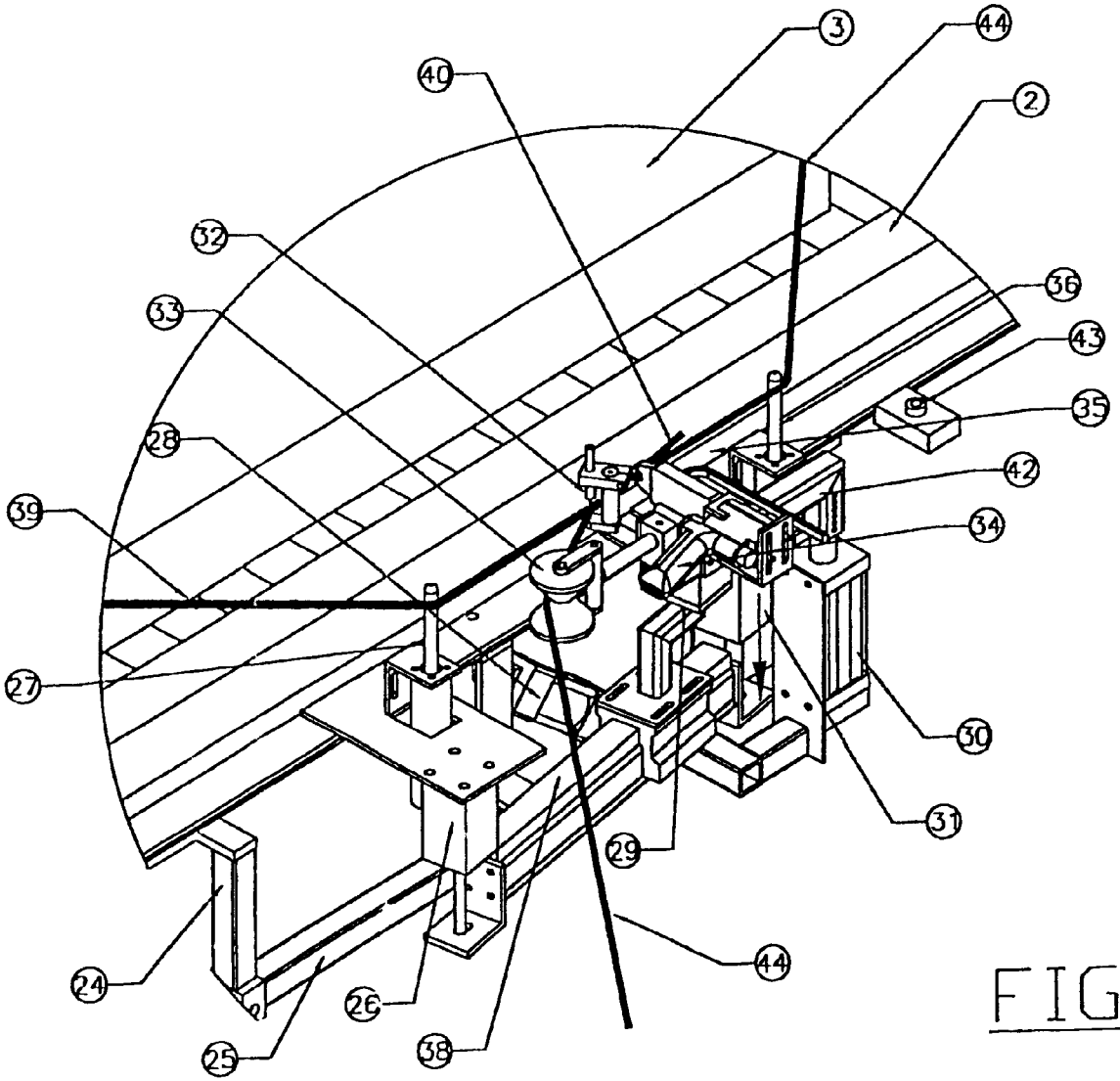
Figure 11:
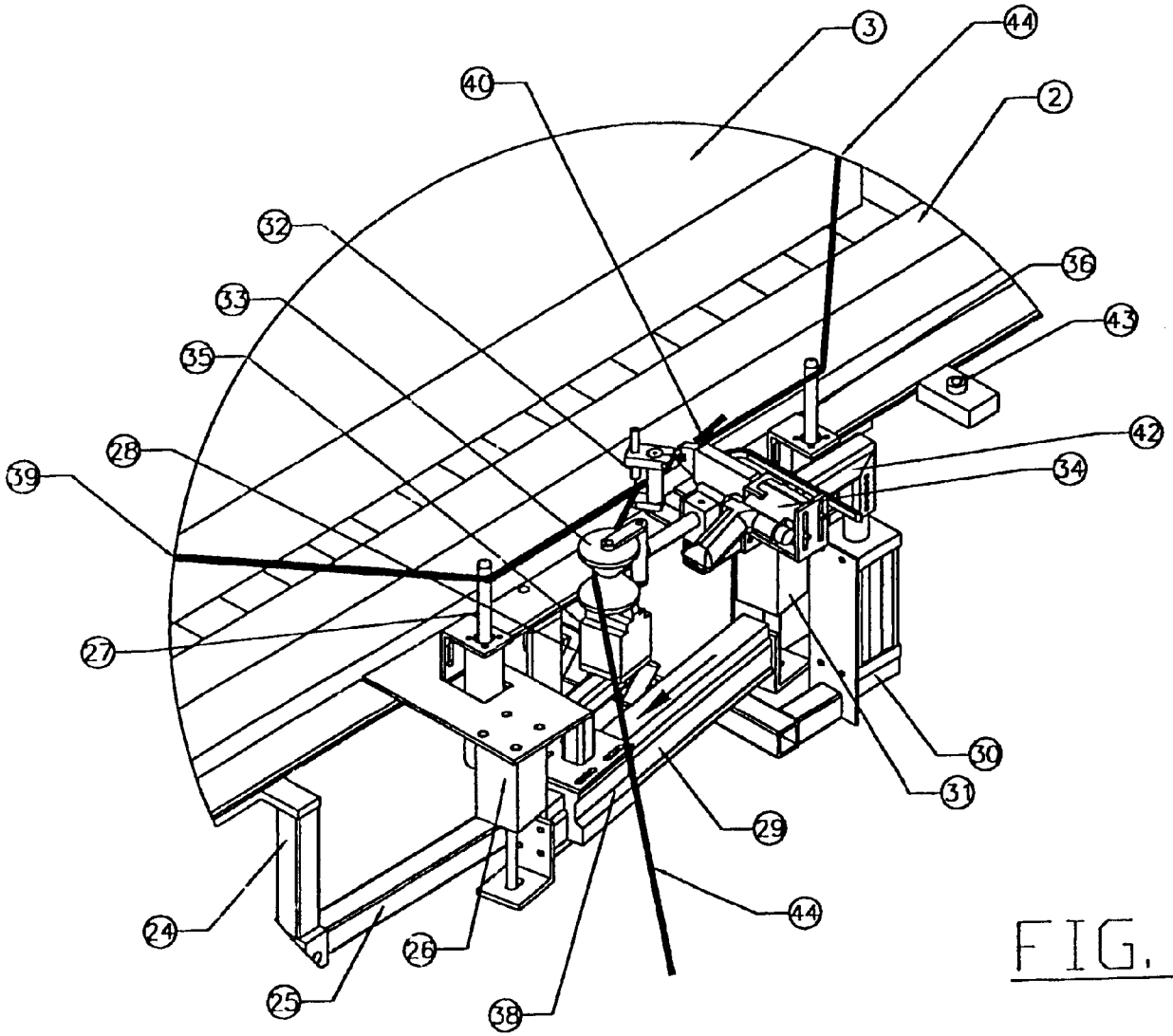
Figure 12:
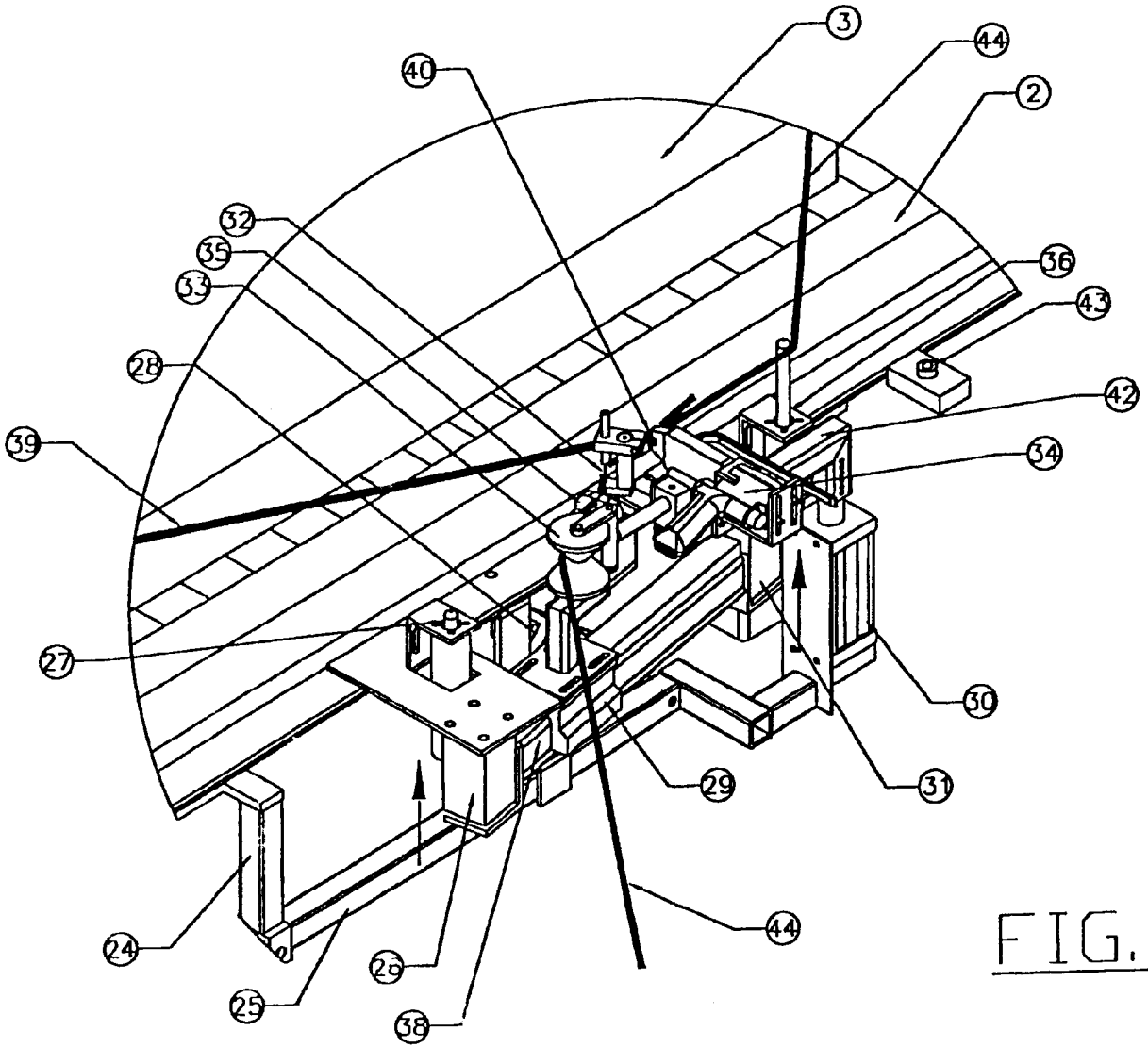
Figure 13:
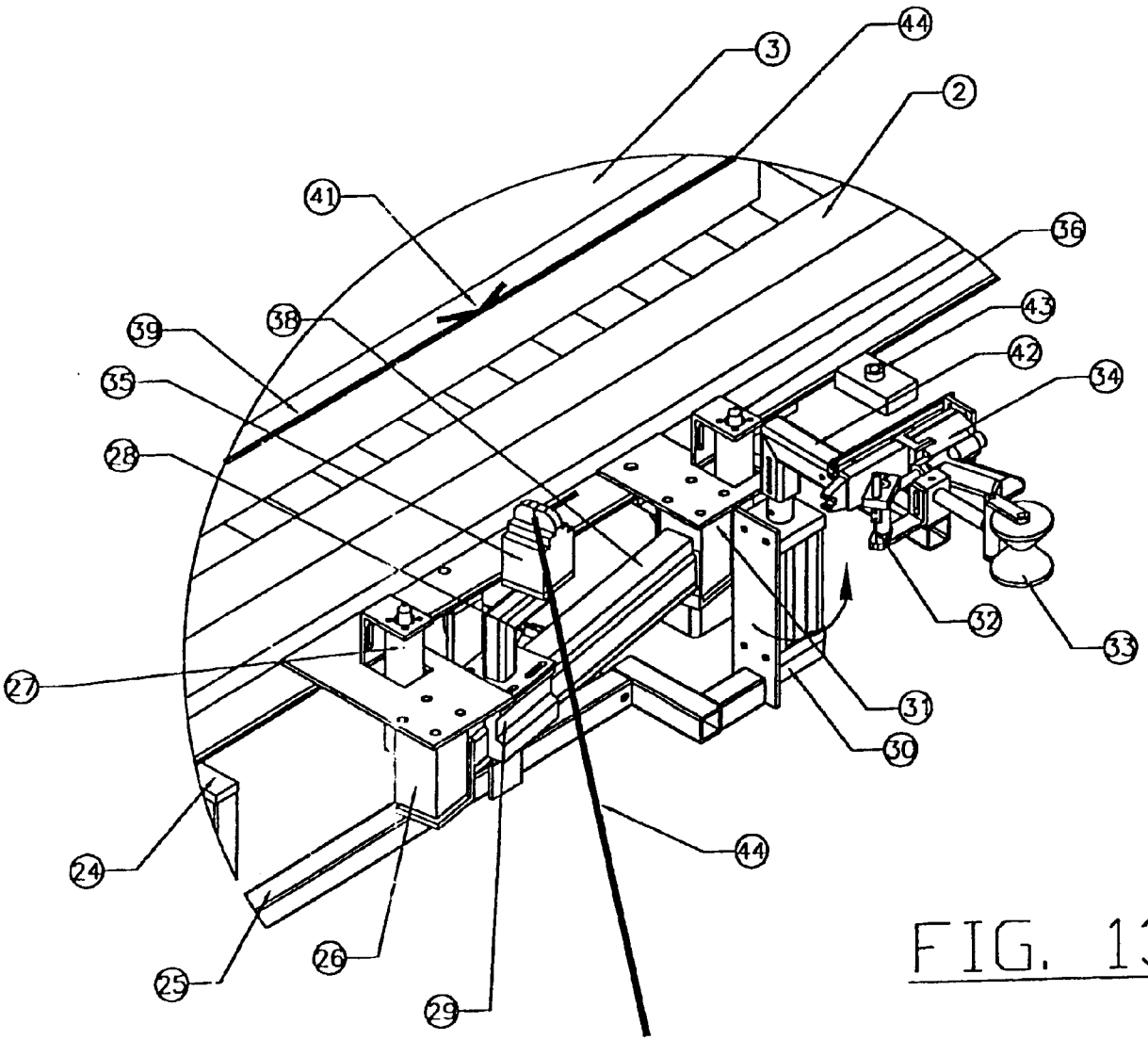

Accordingly, and advantageously, prior to cutting the portion of the second rope, the gripper 35 is opened to release the first rope 39. Subsequently, as shown in FIG. 10, the gripper up/down cylinders 26, 31 are actuated to move the gripper downwardly to clear the clipping arm 42. The gripper 35 is then retracted laterally, passing under the clipping arm 42 (FIG. 11). The gripper up/down cylinders are then actuated to move the gripper upwardly (FIG. 12), so that the gripper is now located between the guide wheel 33 and the heat wire 32, and the gripper is closed to secure the portion of the second rope 44 therein.

Finger 27 is then brought down to an inoperative position to release the portion of the first rope 39. The heat wire is then activated to cut the second rope 44 between the gripper 35 and the clipped rope 41. Finger 36 is retracted to release the clipped rope 41, which, by virtue of the tension present, remains against the load 3. The load is thus now released, and free to move on the conveyor.

The rod-less cylinder 38, the actuator 30 and arm 25 are then moved back to their initial positions, and the system is ready for the next load.

It should be noted that although a specific embodiment of the invention has been described, the present invention consists in the combination of a typical load wrapping machine, with first and second positioning means, fastening means for fastening the first and second ropes together and cutting means for cutting the second rope upstream of where it has been fastened to the first rope. Although fingers, grippers, heat wires, clippers, etc. have been specifically described and illustrated, the objects of the present invention could easily be met with other mechanical devices fulfilling the same functions. Furthermore, in a preferred embodiment of the invention, the first and second grippers are a single gripper movable between a first and second operative positions, but two individual grippers would without difficulty achieve the same function. Also, the clipper 34, guide wheel 33 and heat wire 32, shown being mounted on a single arm, could also be individually mounted and controlled.

Figure 19:
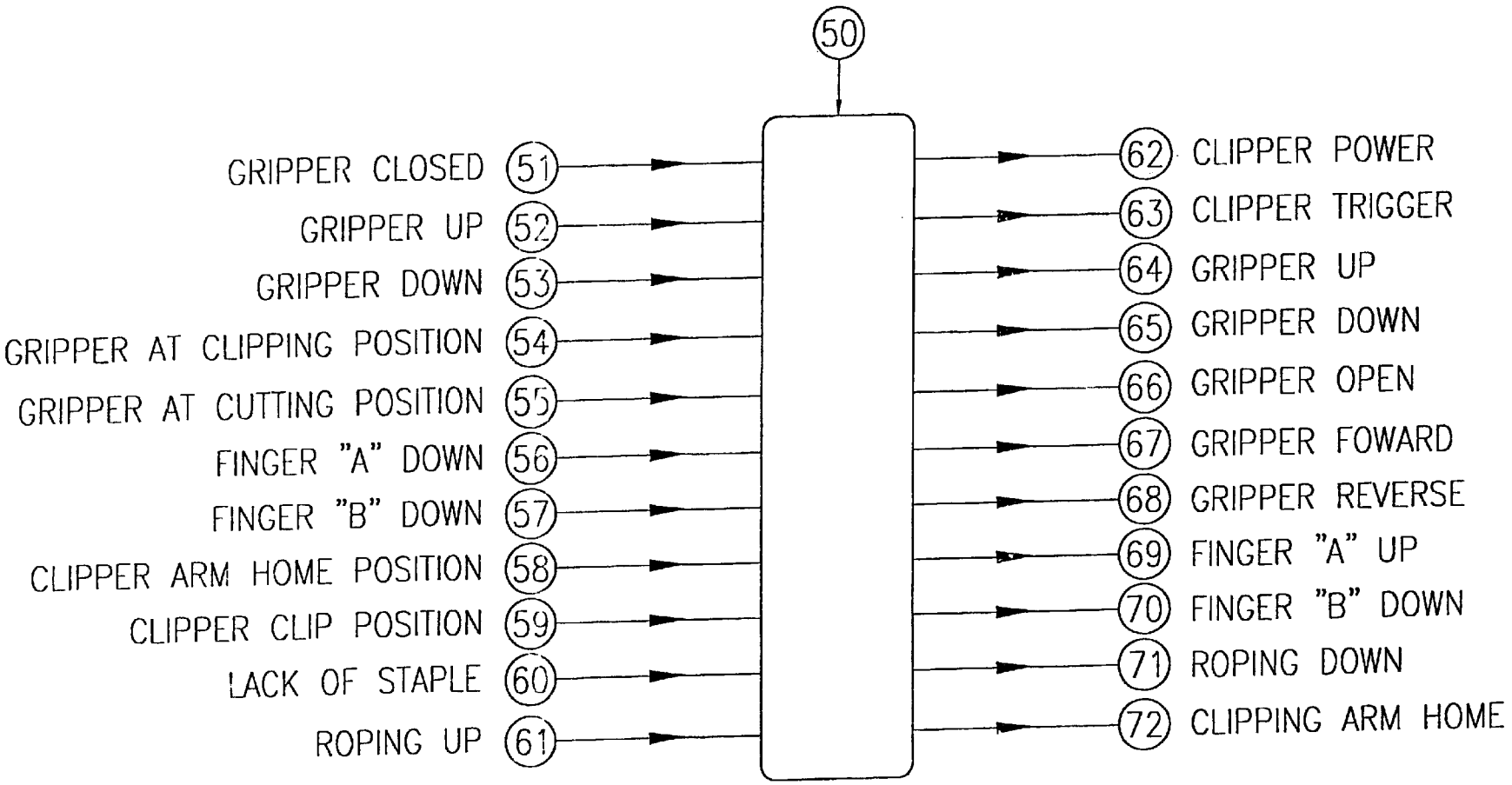
Fig. 19 is a schematic representation of the control means for controlling operation of the apparatus according to a preferred embodiment of the invention.

Referring now to FIG. 19, in order to control operation of the machine and timing thereof, a controller 50 is provided, which is preferably housed in control panel 6. The controller has a plurality of inputs 51–61 and a plurality of outputs 62–72. Inputs 56 and 57 are indicated as referring to finger "A" and finger "B" respectively, which correspond to the first 27 and second 36 fingers, respectively. The inputs are provided through reed switches, proximity sensors and photosensitive sensors which sense displacement and location, so that controller "knows" where all of the components are at any time in the cycle, and sends out the appropriate outputs.

The apparatus according to the present invention can thus wrap loads 3 with traditional film or netting, both of which are included in the expression "flexible material" used in the present description and claims.

Figure 14:
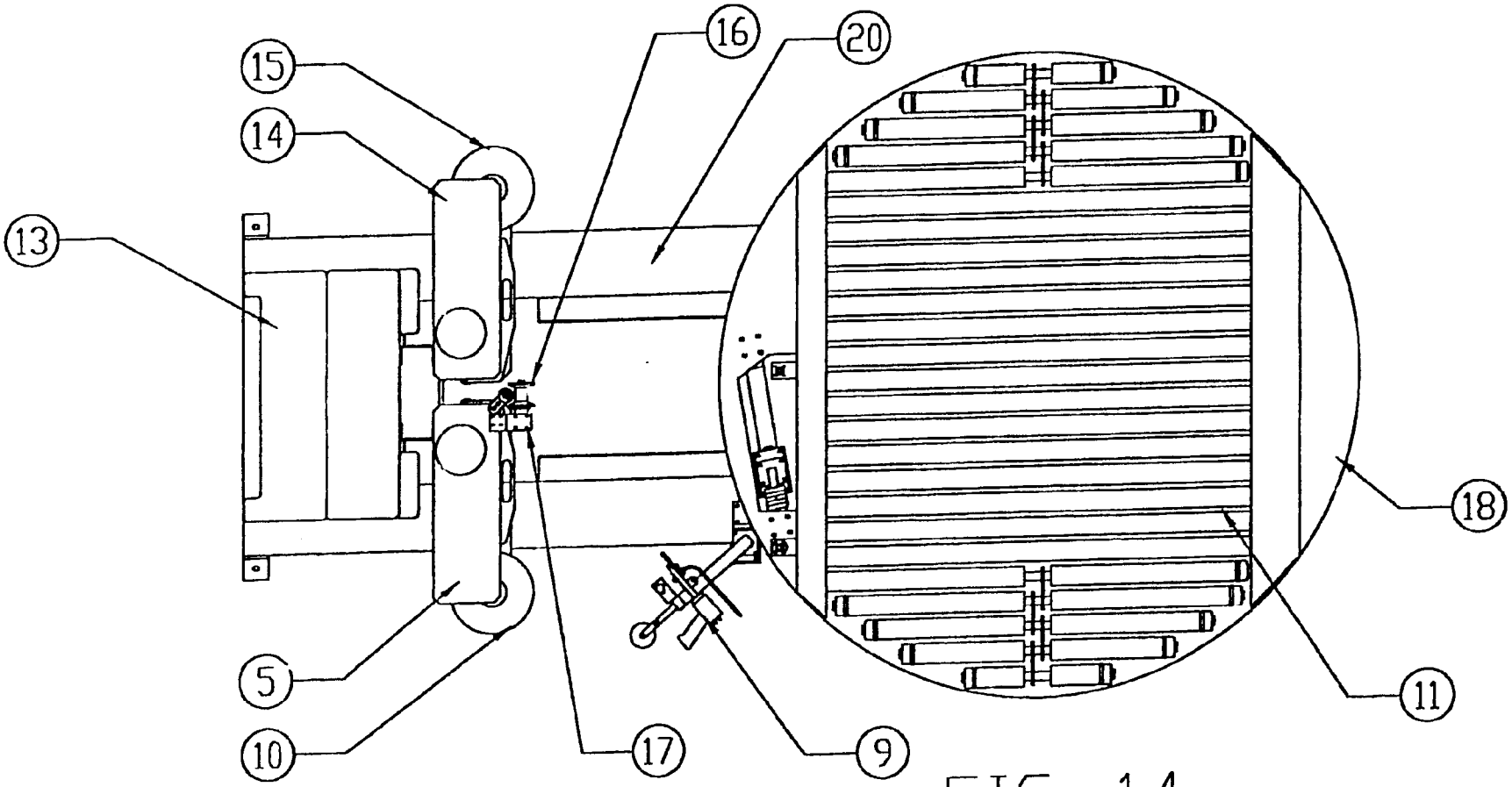
FIG. 14 is a top view of a variation of the apparatus of the invention, including a rotatable conveyor.
Figure 15:
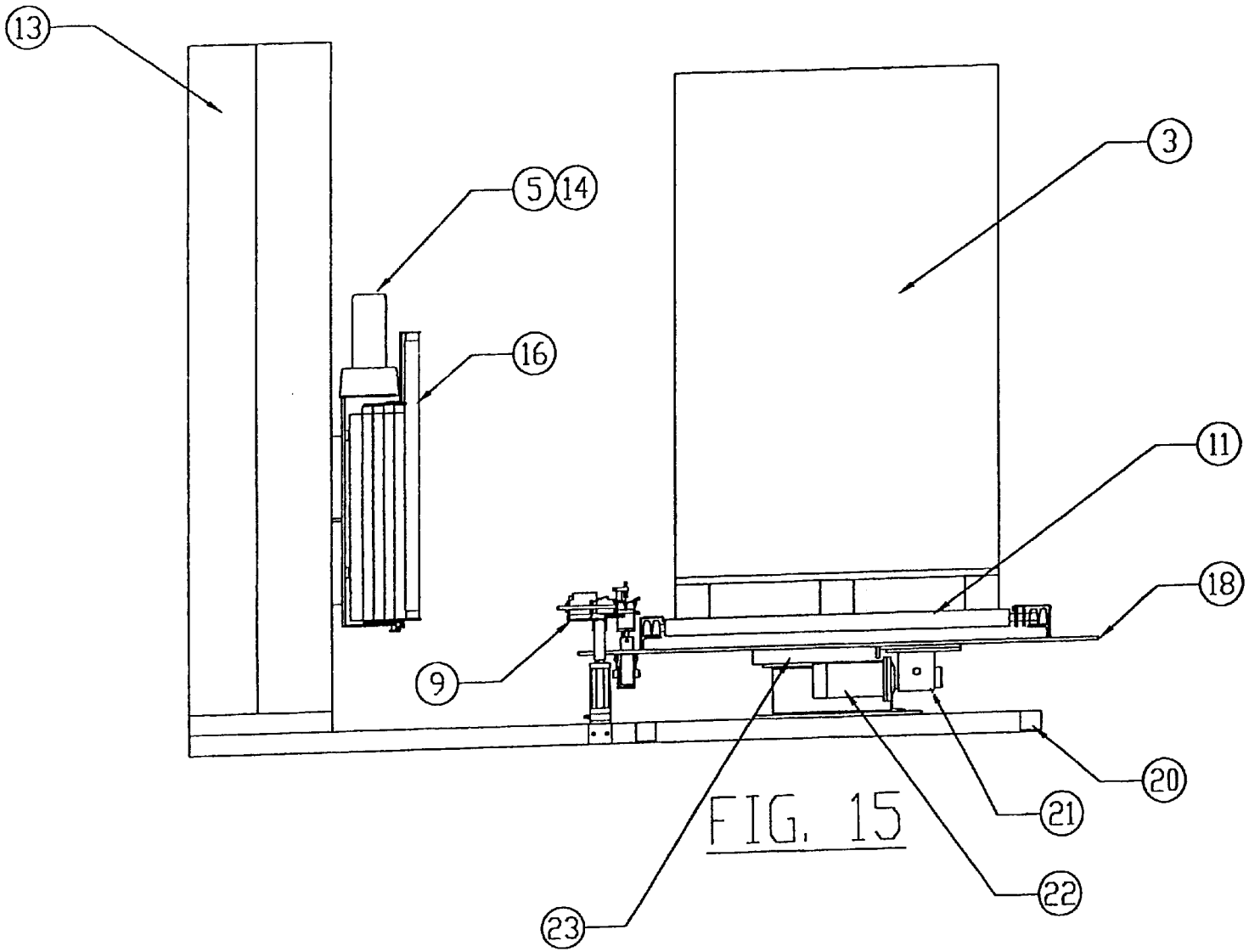
FIG. 15 is a rear elevational view of the apparatus of FIG. 14.
Figure 16:
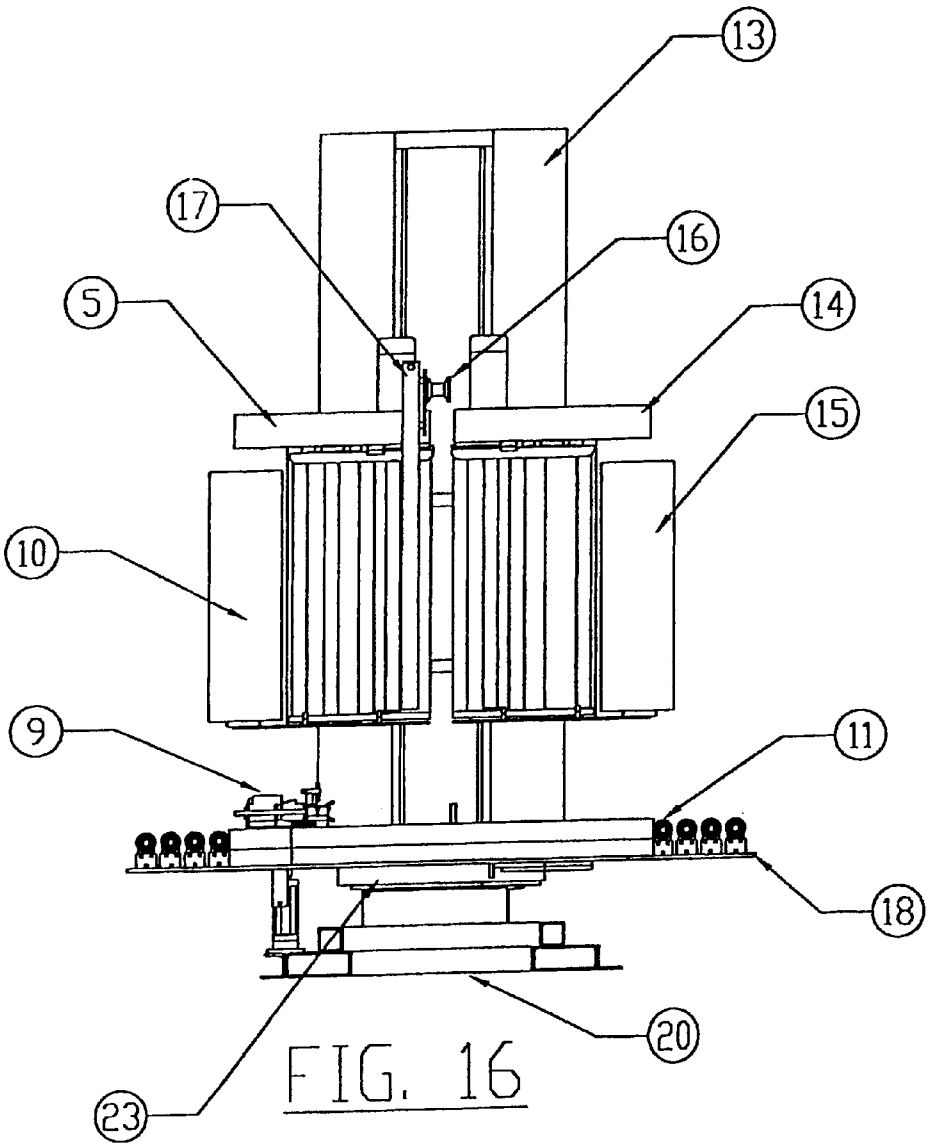
FIG. 16 is a side elevational view of the apparatus of FIG. 14.

In an alternative embodiment of the invention, shown in FIGS. 14–16, the supplying means are mounted on a tower 13 and the load is conveyed to a turntable conveyor 11, so that the load is fixed but the turntable conveyor rotates to effect relative movement between the load and the supplying means. In such a case, the apparatus base frame 20 supports a ring gear 23, and the turntable conveyor 18 is driven by motor 22 through reducer 21. The supplying means comprise a roll of film 15. A film delivering carriage 14 supports the roll of film 15.

Figure 18:
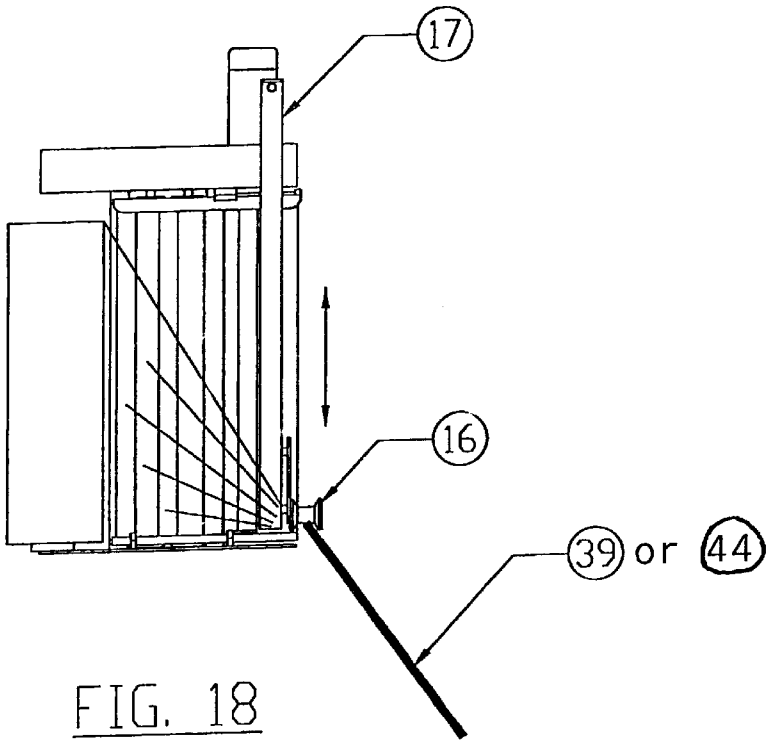
FIGS. 17 and 18 are side views of the supply means showing the delivery of the flexible material as a full web (FIG. 17) and as a rope (FIG. 18)
Figure 17:
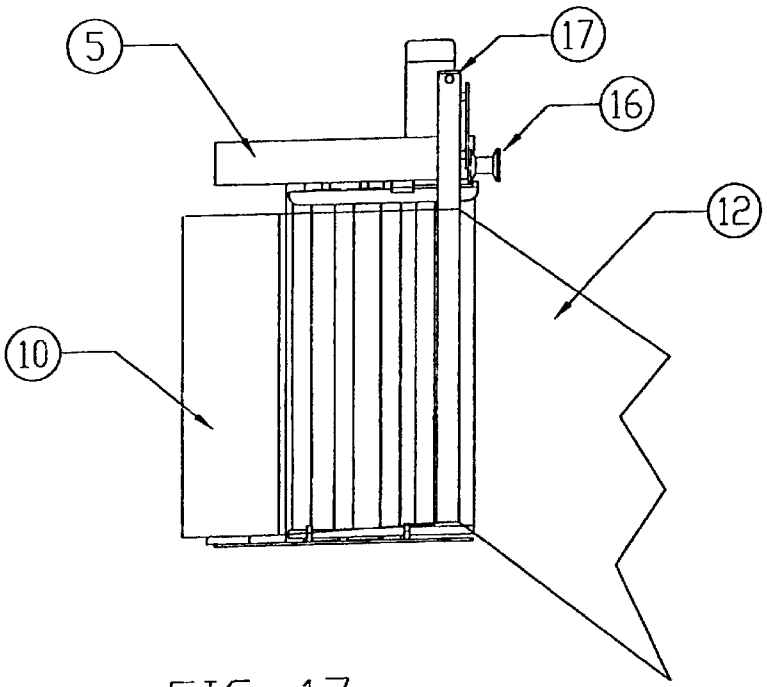

Referring now to FIGS. 17 and 18, the carriage 5 has guiding means, here preferably including a cylinder 17. The cylinder 17 is spaced apart to an elongated element to delimit an elongated gap through which the flexible material 10 is supplied. A roping wheel 16 and moving means for moving the roping wheel 16 along the gap are provided so that in a first operating position, the flexible material 10 is supplied as a full web 12, and in a second operating position, the flexible material 10 is supplied as a rope 39 or 44.

Although the present invention has been explained hereinabove by way of a preferred embodiment thereof, it should be pointed out that any modifications to this preferred embodiment within the scope of the appended claims is not deemed to alter of change the nature and scope of the present invention.

What is claimed is:

1. Apparatus for wrapping a load by means of a flexible wrapping material, said load being placed on a conveyer, comprising:

supplying means for supplying the flexible wrapping material as a rope or as a full web, said supplying means being mounted on an arm, having a bottom surface;

first positioning means for positioning a portion of a first rope supplied by the supplying means at a predetermined location;

means for moving said arm in a circular motion around said load to wrap the load by means of a full web supplied by the supplying means;

second positioning means for positioning a portion of a second rope supplied by the supplying means at the predetermined location;

fastening means for fastening together said portions of the first and second ropes at said predetermined location;

cutting means for cutting the second rope between the portion thereof that has been fastened and the supplying means; and controlling means connected to the supplying means, the first and second positioning means, the means for moving said arm, the fastening means and the cutting means, for controlling operation thereof;

wherein said first positioning means, said fastening means and said cutting means are located under said bottom surface of said arm.

2. An apparatus according to claim 1, wherein the first positioning means include:

a first gripper for gripping an end of said portion of the first rope upstream of the predetermined position; and a first finger located downstream of the predetermined location for positioning said portion of the first rope from the first gripper, at the predetermined location.

3. Apparatus for wrapping a load by means of a flexible wrapping material, comprising:

supplying means for supplying the flexible wrapping material as a rope or as a full web;

first positioning means for positioning a portion of a first rope supplied by the supplying means at a predetermined location;

means for effecting relative movement between the load and the supplying means to wrap the load by means of a full web supplied by the supplying means;

second positioning means for positioning a portion of a second rope supplied by fastening means for fastening together said portions of the first and second ropes at said predetermined location;

fastening means for fastening together said portions of the first and second ropes at said predetermined location;

cutting means for cutting the second rope between the portion thereof that has been fastened and the supplying means; and controlling means connected to the supplying means, the first and second positioning means, the means for effecting relative movement, the fastening means and the cutting means, for controlling operation thereof and wherein the second positioning means include:

a second finger for locating an end of said portion of the second rope upstream of the predetermined location;

a movable guiding wheel for positioning and guiding the second rope; and moving means for moving the guide wheel between a standby position and an active position where said portion of the second rope is positioned from the second finger, at the predetermined location.

4. An apparatus according to claim 1, wherein the fastening means include;

a clipper for fastening together the portions of the first and second ropes at the predetermined location; and a moving means for moving the clipper between a standby position and an active position where the clipper is positioned at the predetermined location.

5. An apparatus according to claim 1, wherein the cutting means include:

a heat wire for cutting the second rope; and a moving means for moving the heat wire between a standby position and an active position where the heat wire is in contact with the second rope.

6. An apparatus according to claim 2, wherein the first gripper is movable between a first and a second operating positions, and said gripper, at said second operating position, grips the second rope between the portion thereof that has been fastened and the supplying means so that the second rope is held in position to be cut between the gripper and the portion thereof that has been fastened.

* * * * *